US009688521B2

(12) United States Patent
Recchia et al.

(10) Patent No.: US 9,688,521 B2
(45) Date of Patent: Jun. 27, 2017

(54) INDUSTRIAL TRUCK WITH AN OVERHEAD GUARD

(71) Applicant: Jungheinrich Aktiengesellschaft, Hamburg (DE)

(72) Inventors: John Recchia, Detroit, MI (US); Kelvin Chan, Jersey Village, TX (US)

(73) Assignee: Jungheinrich Aktiengesellschaft, Hamburg (DE)

( * ) Notice: Subject to any disclaimer, the term of this patent is extended or adjusted under 35 U.S.C. 154(b) by 34 days.

(21) Appl. No.: 14/177,957

(22) Filed: Feb. 11, 2014

(65) Prior Publication Data

US 2015/0225219 A1 Aug. 13, 2015

(51) Int. Cl.
*B66F 9/075* (2006.01)

(52) U.S. Cl.
CPC ..... *B66F 9/07545* (2013.01)

(58) Field of Classification Search
CPC ..... B66F 9/07545; B66F 9/07504
See application file for complete search history.

(56) References Cited

U.S. PATENT DOCUMENTS

| | | | | | |
|---|---|---|---|---|---|
| 2,754,019 | A * | 7/1956 | Watson | 414/634 | |
| 2,806,618 | A * | 9/1957 | Cook | 414/634 | |
| 3,638,758 | A * | 2/1972 | Weisker | 182/112 | |
| 3,844,382 | A * | 10/1974 | Mecklenburg | 187/222 | |
| 4,266,808 | A * | 5/1981 | Fassett | 280/756 | |
| 4,411,464 | A * | 10/1983 | Bauer | 296/102 | |
| 7,101,139 | B1 * | 9/2006 | Benedict | 414/281 | |
| 2008/0001435 | A1 * | 1/2008 | Kraimer | B66F 9/07545 296/190.03 | |

* cited by examiner

*Primary Examiner* — William E Dondero
*Assistant Examiner* — Diem Tran
(74) *Attorney, Agent, or Firm* — Walter Ottesen, P.A.

(57) ABSTRACT

An industrial truck has a lift mast, which has a height-adjustable load support and an overhead guard that is disposed on a side of the lift mast facing away from the load support. The guard protects the operator against falling loads and objects. The lift mast on the side thereof facing away from the load support has an adapter for the overhead guard that has two adapter limbs disposed in parallel to each other and connected to the lift mast. The overhead guard has two projecting connection limbs each of which lies flat on one of the adapter limbs and is connected thereto.

7 Claims, 4 Drawing Sheets

INDUSTRIAL TRUCK WITH AN OVERHEAD GUARD

FIELD OF THE INVENTION

The present invention relates to an industrial truck having a lift mast, which has a height-adjustable load support means and an overhead guard.

BACKGROUND OF THE INVENTION

With industrial trucks, an overhead guard that protects a vehicle driver at his workplace is used for protection against falling loads and objects. With the overhead guard, a basic distinction is made whether the overhead guard is formed as a roof of a driver's cabin or is attached to the lift mast as a component thereof. The present invention relates to an overhead guard which is mounted to the lift mast via an adapter. Conventional adapters have a C-shape, the limbs of which engage on the exterior of the lift frame and have an adapter flange running transverse to the longitudinal direction of the vehicle and parallel to a back wall of the lift mast. The overhead guard is attached to the adapter flange using a row of bolts. The known attachment for the overhead guard has been proven to be disadvantageous in that due to the use of an adapter flange, the visibility through the overhead guard is restricted and the stability of the overhead guard is only limited.

SUMMARY OF THE INVENTION

It is an object of the invention to provide an attachment for an overhead guard that improves the visibility through the overhead guard and simultaneously increases the stability of the attachment thereof.

The industrial truck according to the invention has a lift mast, which has a height-adjustable load support and an overhead guard. The overhead guard is connected to the lift mast and can, for example, be mounted together with the lift mast to the vehicle body of the industrial truck. The overhead guard is disposed on a side of the lift mast facing away from the load support, and forms a protection for the operator against falling loads and objects. For fastening the overhead guard, the lift mast, on the side thereof directed away from the load support, is equipped with an adapter. The adapter has two parallel adapter limbs connected to the lift mast. The adapter limbs are provided for connection to the overhead guard. The overhead guard according to the invention has two projecting connection limbs, each of which lies flat at one of the adapter limbs and is connected thereto. The connection of the overhead guard with the connection limbs thereof at the laterally disposed adapter limbs of the lift mast allows the central region, important for the visibility in the overhead guard, to be configured so that only minimal visibility interference occurs for the vehicle driver. Thus, an adapter flange running transverse to the lift mast can be disposed suitably for the visibility. Additionally, the stability of the overhead guard is significantly improved due to the connection of two connection limbs to two adapter limbs.

In a preferred embodiment, the adapter also has a connection web, which connects the free ends of the adapter limbs to each other. Contrary to the prior art, this connection web does not serve as an adapter flange for attachment of the overhead guard, so that the angle of inclination of the connection web can be selected for good visibility, independent from static considerations.

In a further preferred embodiment, adapter limbs are attached on the side at the exterior of the lift mast. Hereby, also the connection limbs, held by the adapter limbs, have a maximal spatial spacing which permits a stable connection of the overhead guard to the adapter of the lift mast.

In a further preferred embodiment, the overhead guard has a U-shaped frame, each of the limbs of which at an end section forms the connection limbs. Transverse webs, which run transverse to the limbs of the frame, are disposed in the space between the limbs. No transverse webs are provided between the connection limbs because these are connected to the adapter limbs. The transverse webs form the primary protection from falling objects.

In a preferred embodiment, the frame and particularly the limbs of the overhead guard are produced from a flat material, the flat sides of which are oriented vertically. The vertical orientation confers great stability to the overhead guard against falling objects. The transverse webs are also preferably made from a flat material, wherein the flat sides are inclined to the horizontal. The inclination of the transverse webs is such that the driver is also protected from small falling objects, but at the same time also has good visibility through the overhead guard, particularly to the load support of the extended lift mast.

In a preferred further embodiment of the industrial truck according to the invention, the connection limbs of the overhead guard are disposed abutting outwards on the adapter limbs. The U-shape frame of the overhead guard with the connection limbs thereof preferably can rest on the adapter limbs under tension from outside.

The connection limbs are preferably held at the adapter limbs by a plurality of bolts. Hereby it is guaranteed that with a loading of the overhead guard, the connection between connection limbs and adapter limbs undergoes shear stress.

In a preferred configuration, the contact surfaces formed between connection limbs and adapter limbs are oriented in parallel to each other.

In a preferred embodiment, each of the adapter limbs includes two trapping blocks between which the connection limbs are wedged or trapped. In this embodiment the connection limbs can additionally be mounted to the adapter limbs by bolts.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
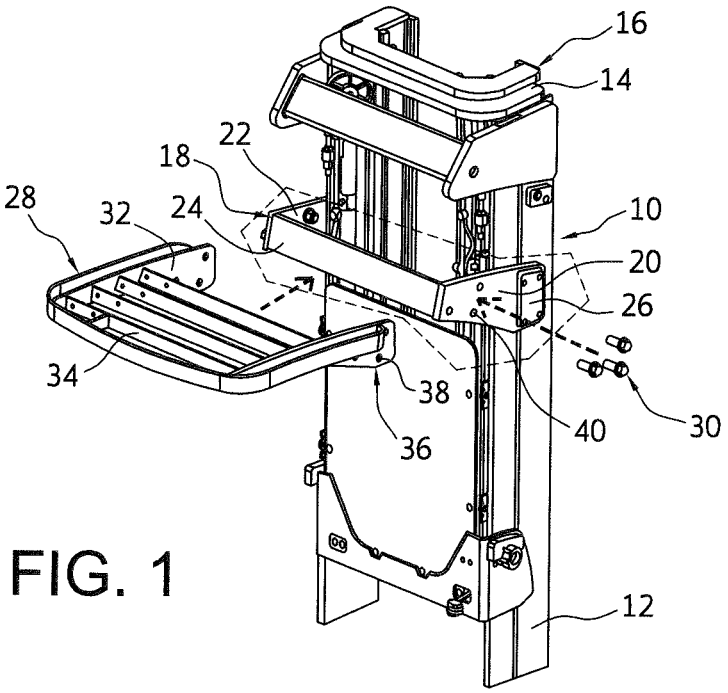
FIG. 1 is a perspective view of a lift mast, not mounted to the industrial truck, having an adapter and an overhead guard on the side of the lift mast facing the vehicle.

FIG. 1 shows a lift mast 10, which has an outer frame 12 provided for connection to the mast retainer (not shown) on the vehicle, and in which two frames 14, 16 are disposed. The frames can be extended from the outer mast in a telescope-like manner.

An adapter 18 is shown enclosed by the broken line and is provided on the outer frame 12 on the backside pointing to the vehicle. The adapter 18 has two adapter limbs 20, 22 which are each attached flat at the outside of the stationary frame 12. The adapter limbs 20, 22 project from the lift mast, and at their respective ends are connected together via a connection web 24. The adapter limbs 20, 22 and the connection web 24 are made of flat metal profiles which are connected together, for example, by welding.

Each of the adapter limbs 20, 22 has a connection region 26. The height of the limbs increases toward the free ends of the adapter limbs 20, 22.

The overhead guard 28 is fastened at each side to the adapter 18 using, for example, three bolts 30. The overhead guard 28 has a U-shaped frame 32, between the mutually parallel limbs of which, transverse webs 34 are disposed. The frame 32 and the transverse webs 34 are each made from flat metal profiles. The transverse webs 34 can be welded, for example, to the inside of the U-shaped frame 32. The free ends of the frame 32 each define a connection limb 36 between which no transverse webs 34 are disposed. The connection limbs 36 each have bore holes 38, which correspond in position and spacing to each of the bore holes 40 in the adapter limbs 20, 22. The connection limb 36 is connected to the adapter 18 using the bolts 30 via the bore holes 38 and 40. The connection web 24 is not connected to the overhead guard.

Figure 2:
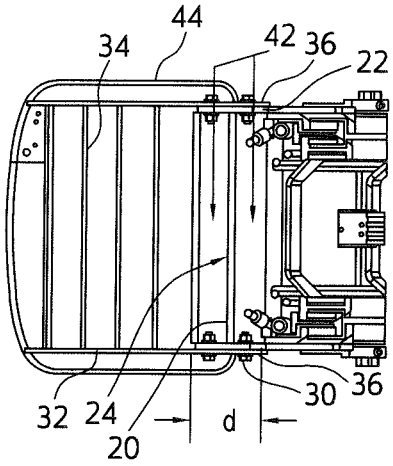
FIG. 2 is a section view of the overhead guard from above taken along line II-II of FIG. 3.
Figure 3:
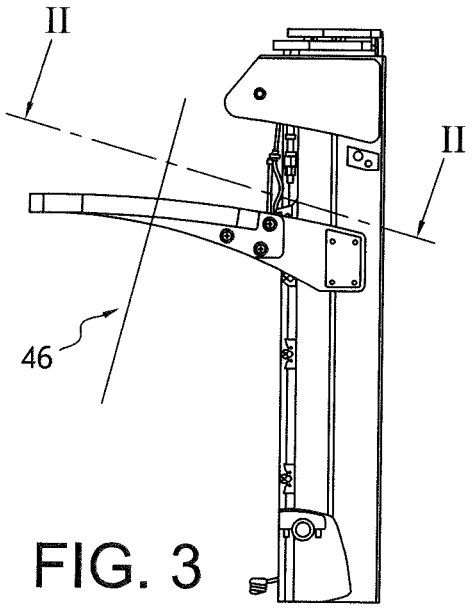
FIG. 3 is a side view of the overhead guard on the lift mast.

FIG. 2 shows a sectional view along the line II-II of FIG. 3, in which the inserted bolts 30 can be seen clearly. The connection limbs 36 and adapter limbs 20, 22 are connected together flat along the distance d. As also seen clearly in FIG. 2, the connection web 24 can be oriented independent of a connection to the overhead guard so that an enlarged visibility region for the driver is provided in the region 42. Also shown in the top view from FIG. 2 is that a circumferential profile 44 additionally envelops the overhead guard.

FIG. 3 shows the overhead guard 28 according to the invention in a side view. Here, the viewing direction 46 is predefined for the driver. The viewing direction 46 is aligned to the extended lift mast. For improved orientation, a line II-II is drawn in FIG. 3 which is perpendicular to the viewing direction 46 and shows the view from FIG. 2.

Figure 4:
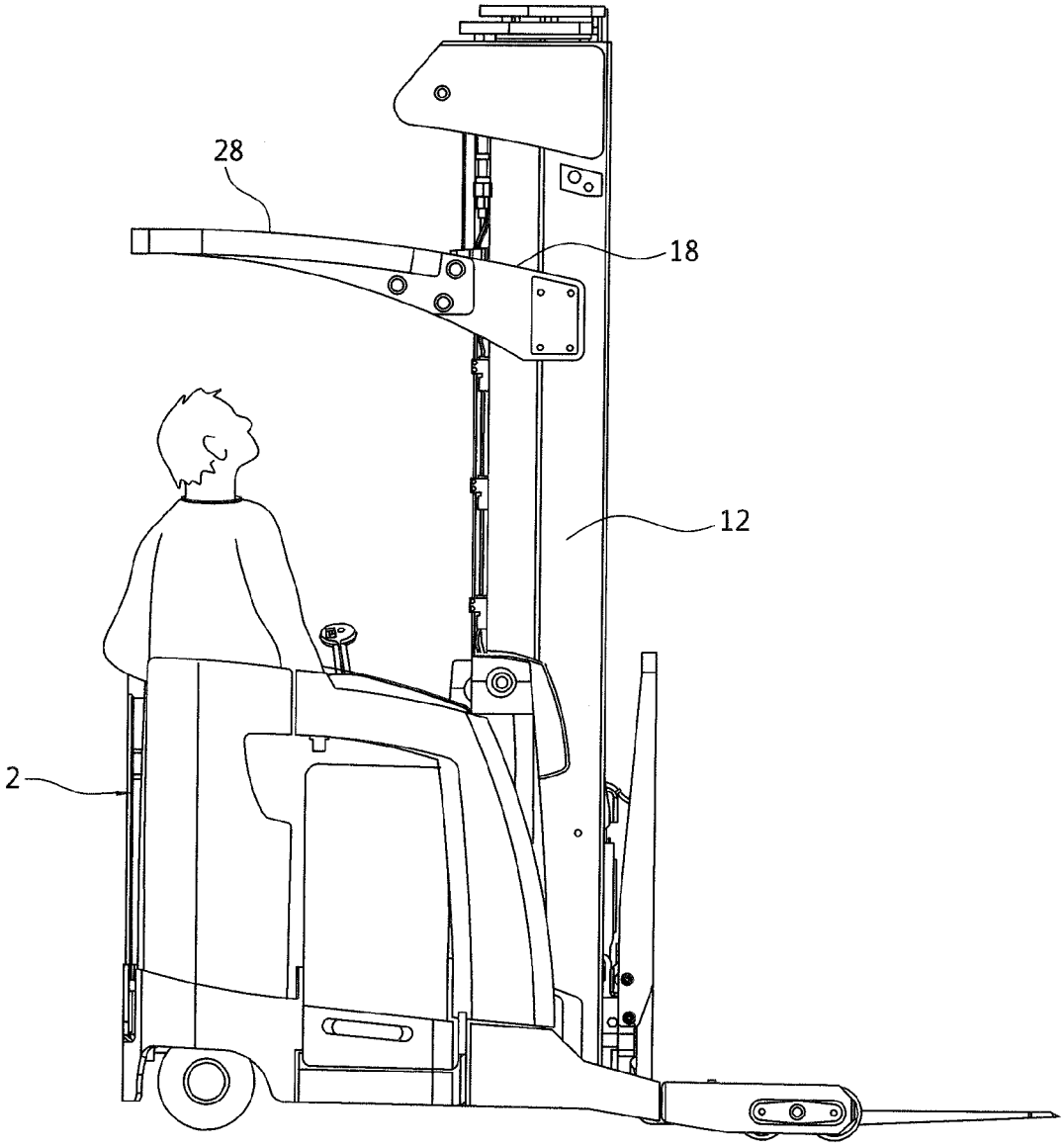
FIG. 4 is a side elevation view of an industrial truck with overhead guard mounted on the lift mast.

FIG. 4 shows the industrial truck 2 in a side elevation view with an operator 4 shown looking up through the overhead guard 28 in the viewing direction 46 shown in FIG. 3. The overhead guard 28 protects the operator against loads which may fall from above during work operations with the industrial truck.

The transverse webs 34 of the overhead guard 28 shown in FIGS. 1 and 2 are made from a flat material wherein the flat sides of the webs are inclined to the horizontal. The inclination of the transverse webs 34 permits the operator to look through the overhead guard with good visibility. At the same time, the guard protects the operator from falling objects.

Figure 5:
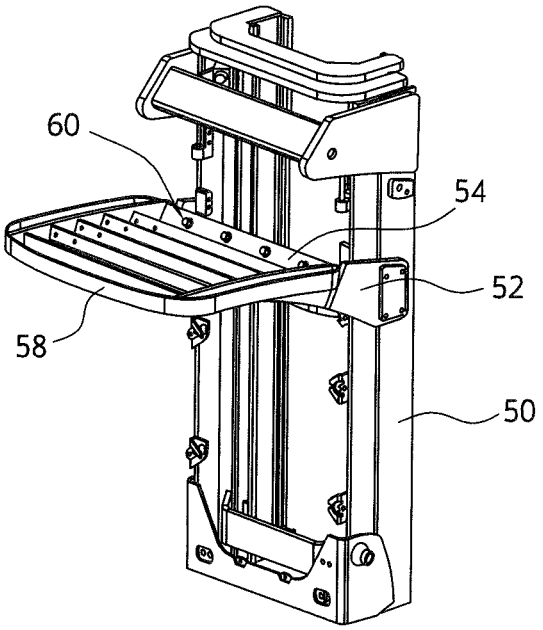
FIG. 5 PRIOR ART
FIG. 5 shows a conventional overhead guard attached to the lift mast.
Figure 6:
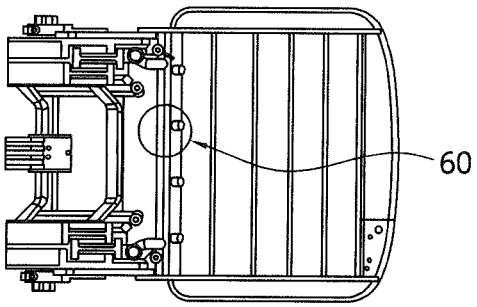
FIG. 6 PRIOR ART
FIG. 6 shows the conventional overhead guard from FIG. 5 in a view from above.

FIG. 5 and FIG. 6 show a lift mast 50 known from the prior art. The lift mast 50 has an adapter 52, which has an adapter flange 54 running transverse to the back side of the lift mast. The overhead guard 58 is connected to the adapter flange 54 using four bolts 60.

As shown in FIG. 6, the inclination of the adapter flange 54 is not freely selectable, rather it maintains the orientation thereof due to the necessary absorption of force from the overhead guard. Thus, the visibility in the region is limited compared to the visibility region 42 from FIG. 2.

Figure 7:
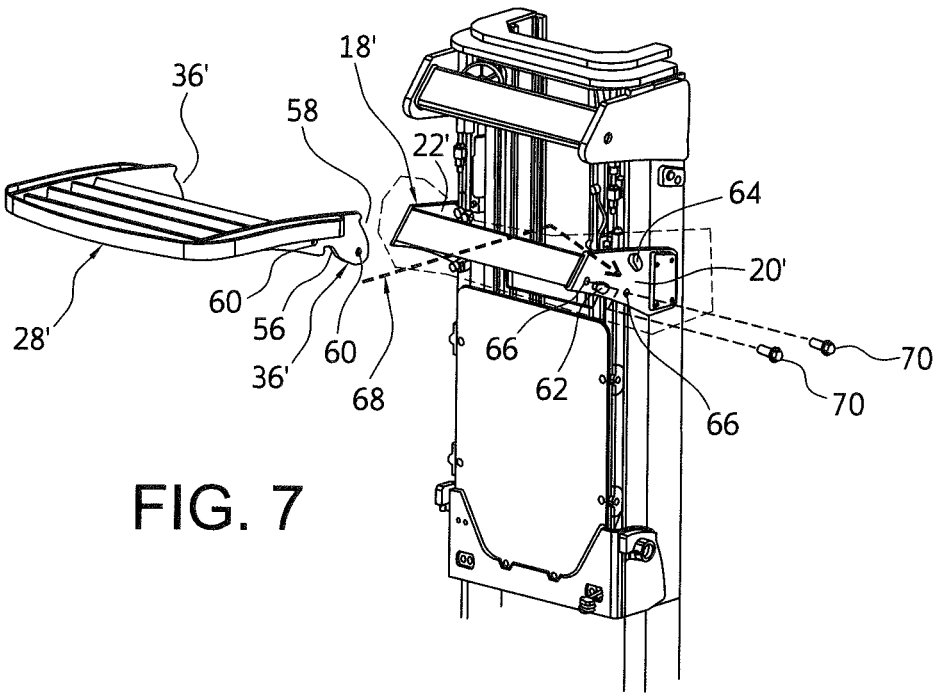
FIG. 7 shows a second embodiment of the invention with the overhead guard mounted to adapter limbs by trapping lug and bolts; and, FIG. 8 shows the overhead guard of FIG. 7 in a mounted state.

FIG. 7 shows an alternative embodiment of the overheard guard 28'. The overhead guard 28' has a U-shaped frame with connection limbs 36' formed at each side of the frame. Each of the connection limbs 36' is provided with two notches 56, 58. The notch 56 is provided at the lower side of the connection limb 36, while the notch 58 is provided at the upper side of the connection limb 36'. Additionally to the notches 56, 58, a pair of bore holes 60 is provided at the connection limb 36'.

The adapter 18' is here too shown enclosed by a broken line and has two parallel adapter limbs 20', 22' which are attached flat at the outside of a stationary frame. The adapter limbs 20', 22' are provided with a pair of trapping lugs 62, 64. The first trapping lug 62 is provided at the lower side of the adapter limbs 20', 22', while the second trapping lug 64 is provided closer to the stationary frame and a little above the first trapping lug. On both sides of the trapping lug 62, bore holes 66 are provided.

During installation, the overhead guard 28' is moved along its mounting path 68'. The connection limb 36' is guided between the two trapping lugs 62, 64. In its final position, the overhead guard 28' is provided at the adapter 18' by introducing the connection limbs 36' between the trapping lugs 62, 64. During this process of installation the notches 56, 58 come into contact with the trapping lugs 62, 64. Additionally, the overhead guard 28' is fixed to the adapter 18' by two bolts 70 which extend through the through-holes 60 of the overhead guard and the through-holes 66 of the adapter limbs 20'. The bolts are attached from the side in shear and not in tension or compression.

Figure 8:
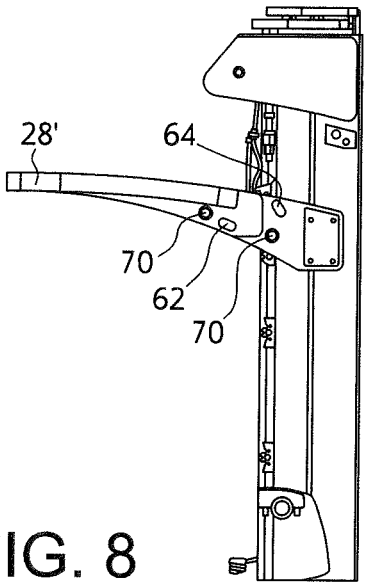

FIG. 8 shows the mounted overhead guard 28'. The side-view shows that the trapping lug 62 supports the connection limb 36' in the notch 56 while the trapping lug 64 is positioned in the notch 58.

It is understood that the foregoing description is that of the preferred embodiments of the invention and that various changes and modifications may be made thereto without departing from the spirit and scope of the invention as defined in the appended claims.

What is claimed is:

1. An industrial truck accommodating an operator therein, the industrial truck comprising:

a lift mast having a forward end and a rearward end and a height adjustable load support disposed on said forward end of said lift mast;

an overhead guard disposed on said rearward end of said lift mast facing away from said height adjustable load support and being configured to guard against falling loads and objects and so protect the operator from injury;

said lift mast further having an adapter disposed on said rearward end and configured for accommodating said overhead guard thereon;

said lift mast defining two lateral sides;

said adapter having two flat adapter limbs having respective flat sides connected to corresponding ones of said lateral sides of said lift mast;

said adapter limbs having respective free ends and being connected to said mast so as to cause said flat sides thereof to be mutually adjacent and lie in respective mutually parallel vertical planes;

said adapter including a connecting web interconnecting said free ends in spaced relationship to said lift mast at the rearward end thereof;

said overhead guard having two projecting connecting limbs configured to lie flat against the flat sides of corresponding ones of said two adapter limbs thereby defining first and second pairs of adapter and connecting limbs;

first and second fastener sets for connecting the limbs of corresponding ones of said pairs to each other with the fasteners of each set extending in a direction perpendicular to corresponding ones of said vertical planes so as to provide a rigid connection between said overhead guard and said adapter wherein said fasteners undergo shear stress in response to said falling loads; and, said connecting web being a thin flat member and being orientated relative to an operator so as to minimize any obstruction to vision of the operator when looking upward along said lift mast.

2. The industrial truck of claim 1, further comprising:

a plurality of cross members;

said overhead guard having a U-shaped frame defining two guard limbs having respective end sections; and, said plurality of cross members being disposed between said two guard limbs.

3. The industrial truck of claim 2, wherein said two guard limbs are made of a flat material and have vertically oriented respective flat sides.

4. The industrial truck of claim 1, wherein said two projecting connecting limbs are held by pin-shaped connectors at respective ones of said adapter limbs.

5. The industrial truck of claim 1, wherein each one of said two projecting connecting limbs together with a corresponding one of said two adapter limbs forms contact surfaces therebetween which are oriented parallel to each other.

6. The industrial truck of claim 1, wherein each of said two adapter limbs includes two trapping lugs; and, said two projecting connecting limbs are each positioned between said two trapping lugs of the corresponding one of said two adapter limbs.

7. An industrial truck accommodating an operator therein, the industrial truck comprising:

a lift mast having a forward end and a rearward end and a height adjustable load support disposed on said forward end of said lift mast;

an overhead guard disposed on said rearward end of said lift mast facing away from said height adjustable load support and being configured to guard against falling loads and objects and so protect the operator from injury;

said lift mast further having an adapter disposed on said rearward end and configured for accommodating said overhead guard thereon;

said lift mast defining two lateral sides;

said adapter having two flat adapter limbs having respective flat sides connected to corresponding ones of said lateral sides of said lift mast;

said adapter limbs having respective free ends and being connected to said mast so as to cause said flat sides thereof to be mutually adjacent and lie in respective mutually parallel vertical planes;

said adapter including a connecting web interconnecting said free ends in spaced relationship to said lift mast at the rearward end thereof;

said overhead guard having two projecting connecting limbs configured to lie flat against the flat sides of corresponding ones of said two adapter limbs thereby defining first and second pairs of adapter and connecting limbs;

first and second fastener sets for connecting the limbs of corresponding ones of said pairs to each other with the fasteners of each set extending in a direction perpendicular to corresponding ones of said vertical planes so as to provide a rigid connection between said overhead guard and said adapter wherein said fasteners undergo shear stress in response to said falling loads;

said connecting web being a thin flat member and being orientated relative to the operator so as to minimize any obstruction to vision of the operator when looking upward along said lift mast;

said overhead guard having a U-shaped frame defining said projecting connecting limbs; and, said overhead guard including a plurality of transverse webs made of a flat material;

said plurality of transverse webs being configured as narrow flat strips having flat sides and being disposed and orientated between said two connecting limbs so as to cause said flat sides to be inclined to define an angle of inclination with respect to said lift mast so as to minimize any obstruction to the vision of the operator when looking upward along said lift mast.

* * * * *